US007222762B2

(12) United States Patent
Rees et al.

(10) Patent No.: US 7,222,762 B2
(45) Date of Patent: May 29, 2007

(54) MOBILE CANISTER

(75) Inventors: Aaron M. Rees, Newburgh, IN (US); Terrance M. Petak, Gibsonia, PA (US); Donald A. Scott, Wadesville, IN (US); David J. Jochem, Evansville, IN (US); Sarah Gilley, Evansville, IN (US); Patricia Ann Waynick, Mars, PA (US)

(73) Assignee: Berry Plastics Corporation, Evansville, IN (US)

( * ) Notice: Subject to any disclaimer, the term of this patent is extended or adjusted under 35 U.S.C. 154(b) by 111 days.

(21) Appl. No.: 11/003,640

(22) Filed: Dec. 3, 2004

(65) Prior Publication Data

US 2006/0118587 A1 Jun. 8, 2006

(51) Int. Cl.

| | |
|---|---|
| ***A45F 3/16*** | (2006.01) |
| ***A45F 3/04*** | (2006.01) |
| ***A45D 15/00*** | (2006.01) |

(52) U.S. Cl. ..... 224/148.4; 224/666; 224/148.4; 224/240; 224/668; 24/3.12; 24/679; 208/38; 208/269

(58) Field of Classification Search ..... 24/3.11, 24/3.12, 3.1; 224/666, 240, 241, 668, 148.4, 224/604, 679; 248/225.21; D3/215; D7/175; 206/38, 269, 811

See application file for complete search history.

(56) References Cited

U.S. PATENT DOCUMENTS

| | | | | | |
|---|---|---|---|---|---|
| 1,718,400 | A * | 6/1929 | Baarsgard | 206/496 |
| 3,395,787 | A * | 8/1968 | Plaskan | 206/259 |
| 4,897,898 | A * | 2/1990 | Chapin | 24/3.12 |
| 5,277,315 | A * | 1/1994 | Plein | 206/270 |
| 5,297,318 | A * | 3/1994 | Adolphson et al. | 24/3.1 |
| D351,341 | S * | 10/1994 | Hung | D9/719 |
| 5,666,274 | A * | 9/1997 | Corso | 361/814 |
| 6,105,923 | A * | 8/2000 | Robertson et al. | 248/682 |
| 6,298,857 | B1 * | 10/2001 | Schmidt | 131/250 |

OTHER PUBLICATIONS

Three photographs of prior art lidded canister.

* cited by examiner

*Primary Examiner*—Tri M. Mai
(74) *Attorney, Agent, or Firm*—Barnes & Thornburg LLP

(57) ABSTRACT

A mobile container includes a container, lid, and belt clip. The belt clip is adapted to be coupled to a belt worn by a person.

16 Claims, 3 Drawing Sheets

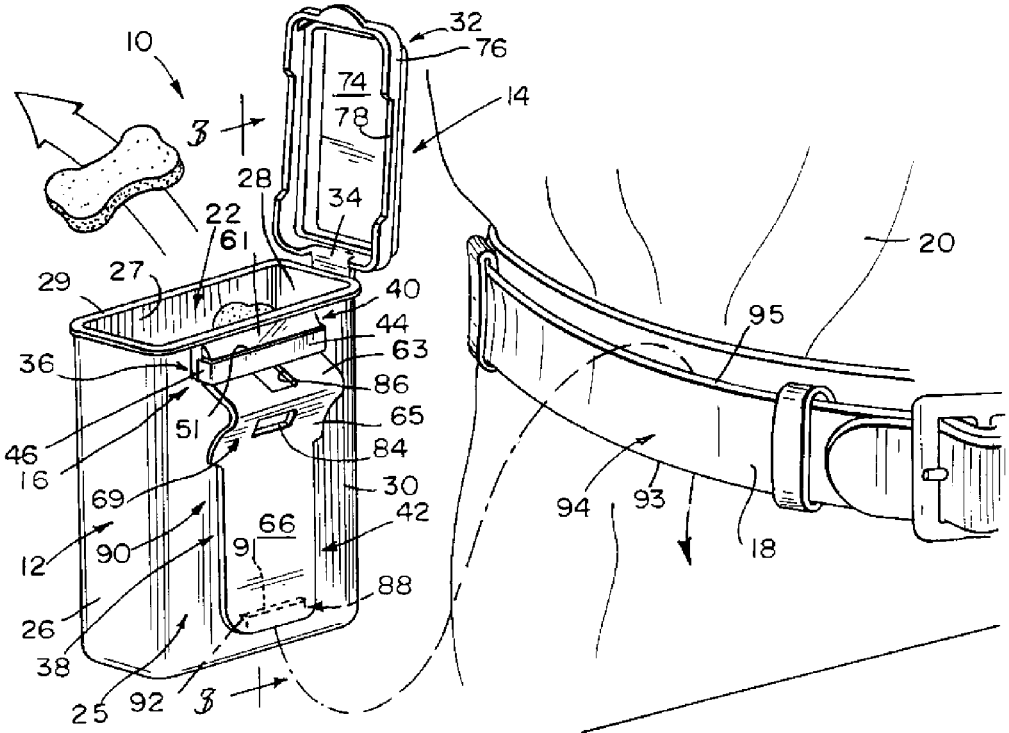
FIG. 1
FIG. 2
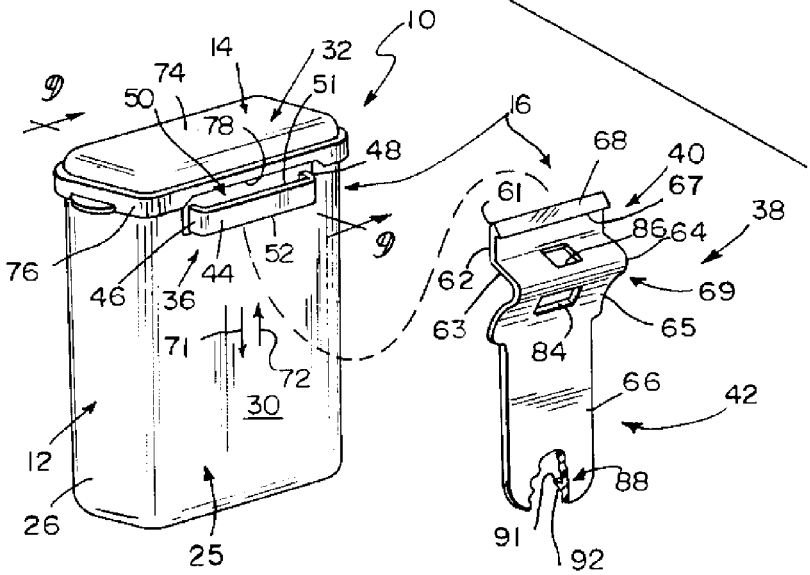

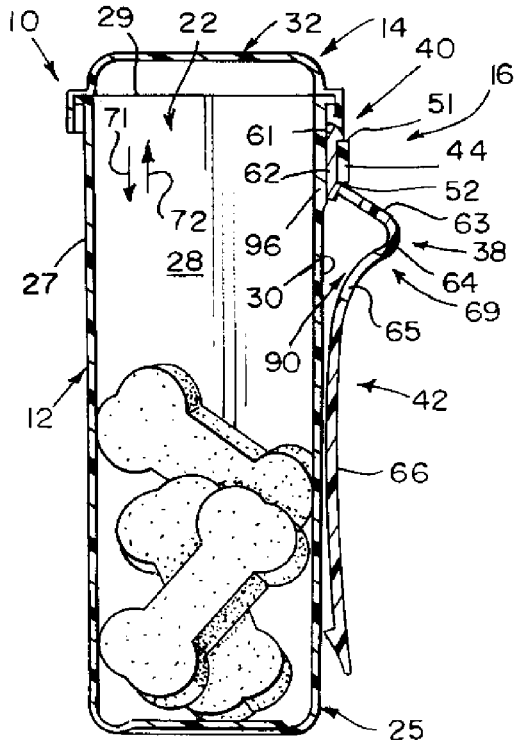
FIG. 3
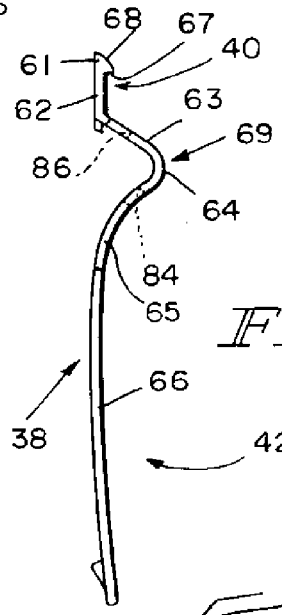
FIG. 4
FIG. 5
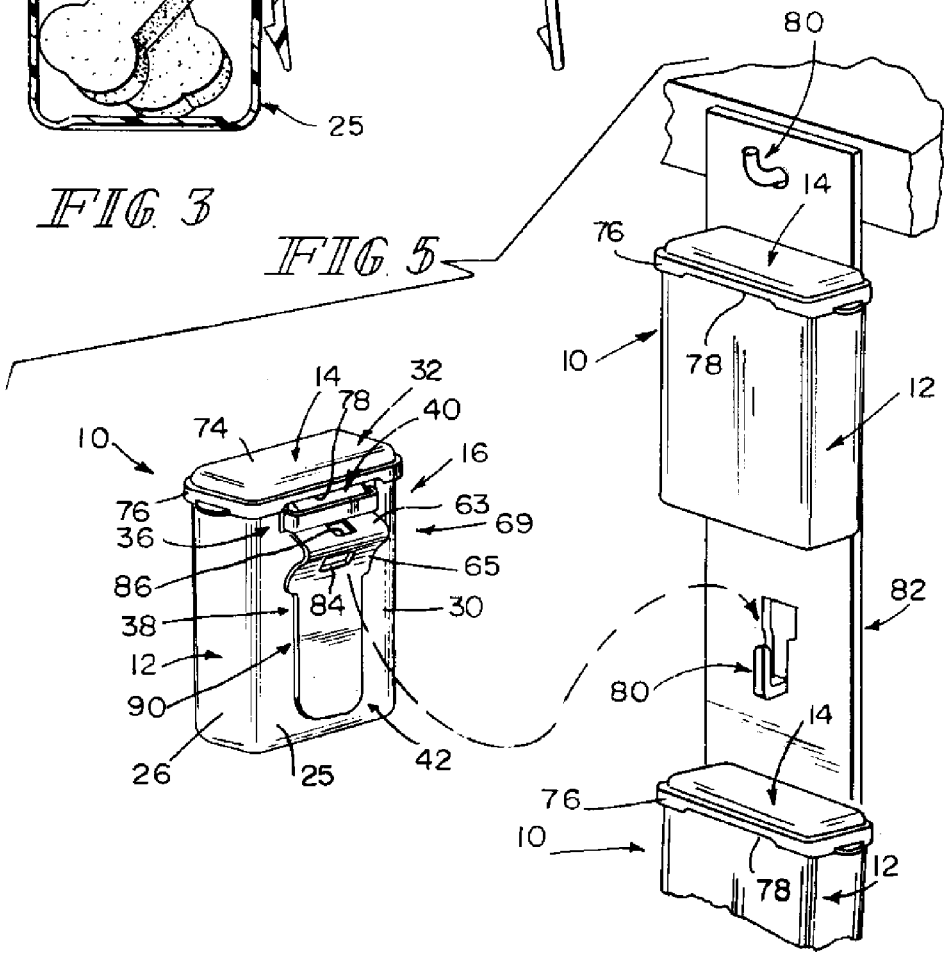

MOBILE CANISTER

BACKGROUND

The present disclosure relates to mobile canisters and, in particular, canisters that include a container and a closeable lid coupled to the container. More particularly, the present disclosure relates to a recloseable, sealable, small portable canister for foodstuffs or other small articles.

SUMMARY

A mobile canister in accordance with the present disclosure includes a container, a lid, and a container mount configured to support the container on a belt worn by a person so that the container and lid are mobile. In an illustrative embodiment, the container is sized and adapted to contain pet treats and the container mount comprises a bracket coupled to the container and a belt clip coupled to the bracket.

Additional features of the disclosure will become apparent to those skilled in the art upon consideration of the following detailed description of illustrative embodiments exemplifying the best mode of carrying out the disclosure presently perceived.

BRIEF DESCRIPTION OF THE DRAWINGS

The detailed description particularly refers to the following figures in which:

FIG. 1 is a perspective view of a mobile canister in accordance with the present disclosure showing the canister as it is about to be clipped to a belt of a user and showing a "flip" lid coupled to a container carrying a belt clip and opened to permit the user to remove pet treats stored in the container;

FIG. 2 is a perspective view showing a belt clip as it is about to be coupled to a clip mounting bracket coupled to an exterior portion of the container and showing the flip lid in a closed position on the container;

FIG. 3 is a sectional view of the canister of FIG. 1 (after closure of the flip lid) showing pet treats stored in the container and mating engagement of the belt clip and the clip mounting bracket;

FIG. 4 is a side elevation view of the belt clip of FIG. 2;

FIG. 5 is a perspective view of the mobile canister of FIGS. 1–3 as it is about to be "hung" on a hook provided on a canister display rack in a retail store by passing the hook through two hook receivers formed in the belt clip and showing two other similar canisters already coupled to the canister display rack;

DETAILED DESCRIPTION

Figure 7:
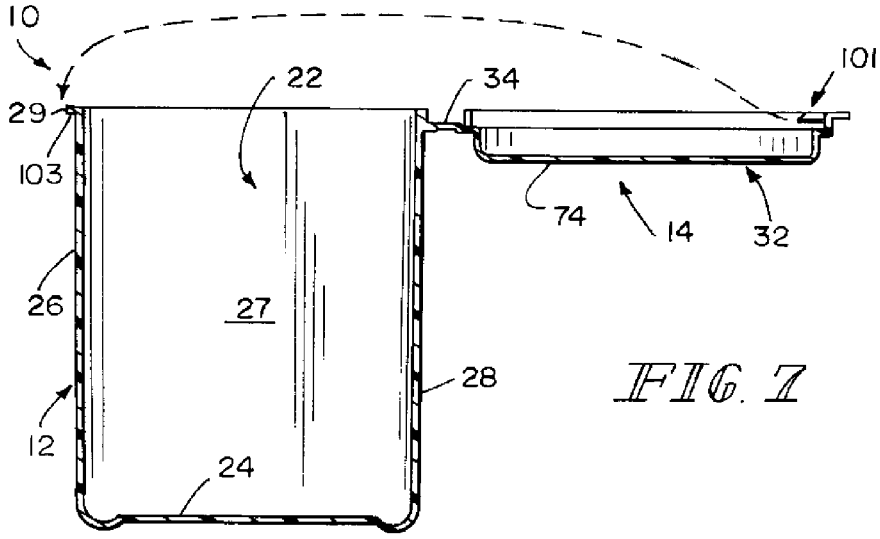
FIG. 7 is a sectional view of the canister of FIG. 6 taken along line 7—7 of FIG. 6 showing a closure and hinge included in the flip lid and suggesting a path along which the closure might move as it pivots on the hinge relative to the container in a counterclockwise direction toward a closed position.

As suggested in FIGS. 1 and 2, a mobile canister 10 includes a container 12, a lid 14, and a container mount 16. Container mount 16 cooperates with container 12 to provide means for supporting container 12 on a belt 18 worn by a person 20 so that container 12 and lid 14 are mobile.

Container 12 is formed to include an interior article-storage region 22. In the illustrated embodiment, the container includes a floor 24 and four side walls 25, 26, 27, 28 terminating at a top edge 29 defining a top opening into interior article-storage region 22. In the illustrated embodiment, side wall 25 provides an exterior surface 30 associated with container mount 16.

Lid 14 includes a closure 32 and a hinge 34 coupled to container 12. Lid 14 is mounted for movement on container 12 between an opened position (shown, for example, in FIGS. 1, 6, and 7) exposing an opening into interior article-storage region 22 in container 12 and a closed position (shown, for example, in FIGS. 2, 3, 5, and 9) closing the opening into interior article-storage region 22. In the illustrated embodiment, container 12 and lid 14 are molded using a plastics material such as polypropylene to form a monolithic unit and hinge 34 is a "living" hinge.

As suggested in FIG. 2, container mount 16 includes a bracket 36 coupled to container 12 and a belt clip 38 configured to be coupled to bracket 36. In the illustrated embodiment, belt clip 38 includes a strip retainer 40 coupled to container 12 and a strip 42 appended to strip retainer 40. Strip 42 is arranged to extend downwardly from strip retainer 40 as suggested in FIGS. 1 and 3 and cooperate with container 12 to provide means for supporting container 12 on a belt 18 worn by a person 20.

Figure 6:
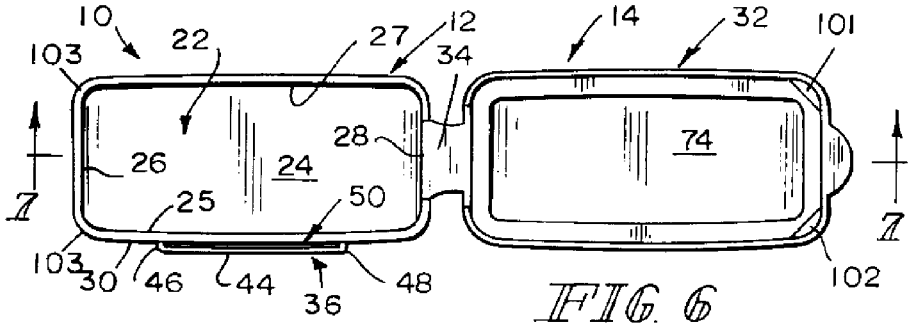
FIG. 6 is a top plan view of the mobile canister of FIG. 1 after the flip lid has been moved to a fully opened position.
Figure 8:
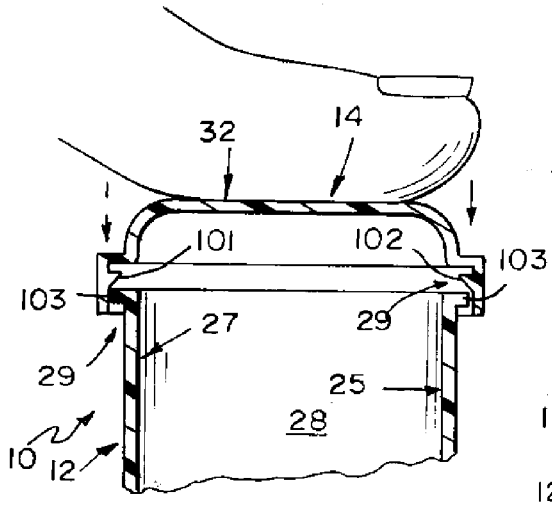
FIG. 8 is a sectional view similar to FIG. 9 showing location of the closure relative to the underlying container before the user pushes downwardly on the lid to "snap" the closure to a closed position on the container.
Figure 9:
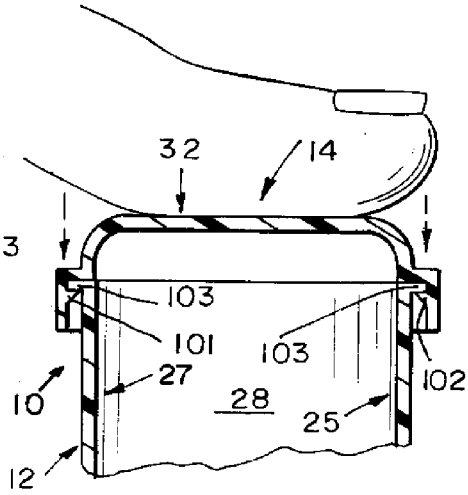
FIG. 9 is a sectional view taken along line 9—9 of FIG. 2 showing the closure retained in a closed position on the container owing to mating engagement of an inwardly extending retainer on the closure with an outwardly extending flange on the container.

As suggested in FIGS. 2 and 6, bracket 36 includes a strip support bar 44 and first and second standoffs 46, 48 coupled to side wall 25 of container 12 and to strip support bar 44. Strip support bar 44 interconnects distal portions of first and second standoffs 46, 48. Strip support bar 44 is located in spaced-apart relation to side wall 25 of container 12 to define a retainer receiver channel 50 therebetween. Strip support bar 44 includes an upper edge 51 located a first distance from lid 14 and top edge 29 of container 12 and a lower edge 52 located a grater second distance from lid 14 and top edge 29 of container 12 as suggested, for example, in FIG. 3.

In the illustrated embodiment, as shown, for example, in FIG. 4, belt clip 38 includes in series an anchor 61, a bracket plate 62, an upper inclined segment 63 having a generally "negative" slope, a ridge 64, a lower inclined segment 65 having a generally "positive" slope, and an elongated distal tongue portion 66. Anchor 61 and bracket plate 62 cooperate to define strip retainer 40. Inclined segments 63, 65 and ridge 64 cooperate to define a proximal root portion 69 of strip 42 and cooperate with distal tongue portion 66 to define strip 42 itself.

As suggested in FIGS. 2 and 3, bracket plate 62 of strip retainer 40 is arranged to extend through retainer receiver channel 50 formed in bracket 36. Strip 42 is appended to a lower portion of bracket plate 62 while anchor 61 is appended to an upper portion of bracket plate 62.

Anchor 61 is arranged to engage strip support bar 44 to block discharge of bracket plate 62 from retainer receiver channel 50 and movement of strip 42 away from bracket 36. Anchor 61 includes stop means 67 for engaging upper edge 51 of strip support bar 44 to block movement of anchor 61 in a first direction 71 through retainer receiver channel 50 as suggested in FIGS. 3 and 4. Anchor 61 also includes ramp means 68 for engaging lower edge 52 of strip support bar 44 and expanding retainer receiver channel 50 formed by flexible bracket 36 to allow movement of stop means 67 in an opposite second direction 72 through retainer receiver channel 50 during movement of strip 42 in opposite second direction 72 toward bracket 36 so that stop means 67 lies in confronting relation to upper edge 51 of strip support bar 44 as also suggested in FIGS. 3 and 4. As shown best in FIG. 1, anchor 61 is located in a space between top edge 29 of container 12 and upper edge 51 of strip support bar 44 when belt clip 38 is coupled to bracket 36.

As suggested in FIGS. 1 and 2, closure 32 of lid 14 includes a top wall 74 closing the opening into interior article-storage region 22 upon movement of lid 14 to assume the closed position. Closure 32 also includes a side wall 76 appended to a perimeter of top wall 74 and arranged to surround an upper portion of container 12 when lid 14 is closed. Side wall 76 is formed to include a cutout 78 and anchor 61 is arranged to lie in cutout 78 upon movement of lid 14 to the closed position as shown in FIGS. 2 and 5.

As shown best in FIGS. 2 and 4, strip 42 includes a distal tongue portion 66 and a proximal root portion 69. Distal tongue portion 66 is arranged to extend along exterior surface 30 of container 12 in downward direction 71 away from bracket 36. Proximal root portion 69 is arranged to interconnect bracket plate 62 and distal tongue portion 66. Proximal root portion 69 is also formed to include a hook receiver adapted to receive a hook 80 provided on a canister display rack 82 to support container 12 on hook 80 as suggested, for example, in FIG. 5. Proximal root portion 69 provides means interconnecting distal tongue portion 66 and strip retainer 40 for receiving a hook 80 on a canister display rack 82 to support container 12 on hook 80.

As suggested in FIGS. 2 and 5, first inclined segment 65 of proximal root portion 69 is appended to an upper part of distal tongue portion 66 and is formed to include a lower hook receiver 84. Second inclined segment 63 of proximal root portion 69 is appended to a lower part of bracket plate 62 and is formed to include an upper hook receiver 86. In the illustrated embodiment, lower hook receiver 84 has a rectangular shape, upper hook receiver 86 has a square shape, and lower hook receiver 84 is wider than upper hook receiver 86.

As suggested in FIG. 4, first inclined segment 65 is curved and includes a convex surface facing toward exterior surface 30 of side wall 25 of container 12. Second inclined surface 63 is substantially flat. Distal tongue portion 66 has a width and first inclined segment 65 has a width that is greater than the width of first inclined surface 65 as suggested in FIG. 2. As suggested in FIG. 4, first inclined segment 65 cooperates with distal tongue portion 66 to form an obtuse included angle therebetween. Second inclined segment 63 cooperates with strip retainer 40 to form an obtuse included angle therebetween.

As suggested in FIGS. 1 and 2, belt clip 38 further includes a belt flange 88 appended to strip 42 to face and project toward exterior surface 30 of side wall 25 of container 12. Belt flange 88 is arranged to lie in spaced-apart relation to bracket 36 to define a belt-receiving space 90 located therebetween and also located between strip 42 and exterior surface 30 of container 12 as suggested in FIGS. 1 and 3. Belt flange 38 is formed to include a horizontal upper surface 91 facing toward bracket 36 and an inclined lower ramp surface 92 facing away from bracket 36. Upper surface 91 provides means for engaging a lower edge 93 of a belt 94 worn by a person 20 and arranged to extend through belt-receiving space 90 as suggested in FIG. 1. Inclined lower ramp surface 92 is oriented to provide means for engaging an upper edge 95 of belt 94 to move distal tongue portion 66 away from container 12 to admit a portion of belt 94 into belt-receiving space 90 as mobile canister 10 is coupled to belt 94.

Container 12 also includes a rigidifying section 96 appended to exterior surface 30 of side wall 25 as shown best in FIG. 3. Rigidifying section 96 is arranged to project outwardly from exterior surface 30 in a direction away from interior article-storage region 22. Bracket 36 is coupled to rigidifying section 96 and is shorter in length than rigidifying section 96. As suggested in FIG. 3, strip retainer 40 is arranged to contact rigidifying section 96 when belt clip 38 is coupled to bracket 36.

As shown best in FIGS. 1 and 3, bracket 36 provides means for retaining bracket plate 62 in a fixed position on rigidifying section 96 and relative to exterior surface 30. Such retention biases distal tongue portion 66 in a direction toward exterior surface 30 to define belt-receiving space 90 between exterior surface 30 and distal tongue portion 66 so that container 12 can be supported on a belt 94 worn by a person 20.

Lid 14 is configured to "snap" to a closed position on container 12 as suggested in FIGS. 6–9. Closure 32 of lid 14 includes, for example, two inwardly extending retainers 101, 102 at corner portions of lid 14 as shown in FIGS. 6 and 7. When closure 32 is moved to the position over container 12 shown in FIG. 8 and then a downward force is applied to closure 32, closure 32 is moved to assume the closed position on container 12 shown in FIG. 9. This retention is owing to mating engagement of inwardly extending retainers 101, 102 on closure 32 with an outwardly extending flange 103 at top edge 29 of container 12.

Mobile canister 10 includes a recloseable, sealable, small, portable container 12 provided with a belt clip 38. It is made in an illustrative embodiment from polypropylene or other suitable material to provide a moisture barrier to maintain freshness of foodstuffs stored in canister 10. Belt clip 38 snaps in place so that canister 10 can be hung on a belt 94 for portability. This small crush-resistant container could also be placed in a person's pocket as an option for portability. Belt clip 38 is adapted to be coupled to a conventional clip strip. Flip lid 14 allows for one-handed opening and closing in the field. Flange 103 is designed to accommodate heat-sealed thin membrane thereon when lid 14 is closed to enhance product freshness.

The invention claimed is:

1. A mobile canister comprising a container formed to include an interior article-storage region, a lid mounted for movement on the container between an opened position exposing an opening into the interior article-storage region and a closed position closing the opening into the interior article-storage region, and a container mount including a bracket coupled to the container and a belt clip including a strip retainer coupled to the bracket and a strip appended to the strip retainer and arranged to extend downwardly from the strip retainer and cooperate with the container to provide means for supporting the container on a belt worn by a person so that the container and lid are mobile, wherein the bracket includes a strip support bar and first and second standoffs coupled to the container and to the strip support bar to locate the strip support bar in spaced-apart relation to the container to define a retainer receiver channel therebetween and the strip retainer is arranged to extend through the retainer receiver channel to orient the strip alongside the container and wherein the strip includes a distal tongue portion arranged to extend along an exterior surface of the container, a first inclined segment appended to an upper part of distal tongue portion and formed to include a lower hook receiver, and a second inclined segment appended to a lower part of the bracket plate and formed to include an upper hook receiver.

2. The mobile canister of claim 1, wherein the strip retainer includes a bracket plate arranged to extend through the retainer receiver channel, the strip is appended to a lower portion of the bracket plate, and the strip retainer further includes an anchor appended to an upper portion of the bracket plate to lie adjacent to the lid upon movement of the lid to assume the closed position and arranged to engage the strip support bar to block discharge of the bracket plate from the retainer receiver channel and movement of the strip away from the bracket.

3. The mobile canister of claim 2, wherein the strip support bar includes an upper edge located a first distance from the lid and a lower edge located a greater second distance from the lid, and the anchor includes stop means for engaging the upper edge of the strip support bar to block movement of the anchor in a first direction through the retainer receiver channel and ramp means for engaging the lower edge of the strip support bar and expanding the retainer receiver channel to allow movement of the stop means in an opposite second direction through the retainer receiver channel during movement of the strip in the opposite second direction toward the bracket so that the stop means lies in confronting relation to the upper edge of the strip support bar.

4. The mobile canister of claim 2, wherein the container further includes a top edge defining the opening into the interior article-storage region and the anchor is located in a space between the top edge of the container and the upper edge of the strip support bar.

5. The mobile canister of claim 2, wherein the lid includes a top wall closing the opening into the interior article-storage region upon movement of the lid to assume the closed position and a side wall appended to the top wall and arranged to extend downwardly along an exterior surface of the container, the side wall is formed to include a cutout, and the anchor is arranged to lie in the cutout upon movement of the lid to assume the closed position.

6. The mobile canister of claim 2, wherein the strip includes a distal tongue portion arranged to extend along an exterior surface of the container in a downward direction away from the bracket and a proximal root portion arranged to interconnect the bracket plate and the distal tongue portion and formed to include a hook receiver adapted to receive a hook on a canister display rack to support the container on the hook.

7. The mobile canister of claim 1, wherein the strip includes a distal tongue portion arranged to extend along an exterior surface of the container and means interconnecting the distal tongue portion and the strip retainer for receiving a hook on a canister display rack to support the container on the hook.

8. The mobile canister of claim 1, wherein the strip support bar includes an upwardly facing surface oriented to face toward the lid upon movement of the lid to the closed position and a downwardly facing surface oriented to face away from the lid upon movement of the lid to the closed position, the strip retainer is arranged to engage the upwardly facing surface of the strip support bar, and the second inclined segment is arranged to engage the downwardly facing surface of the strip support bar.

9. A mobile canister comprising a container formed to include an interior article-storage region, a lid mounted for movement on the container between an opened position exposing an opening into the interior article-storage region and a closed position closing the opening into the interior article-storage region, and a container mount including a bracket coupled to the container and a belt clip including a strip retainer coupled to the bracket and a strip appended to the strip retainer and arranged to extend downwardly from the strip retainer and cooperate with the container to provide means for supporting the container on a belt worn by a person so that the container and lid are mobile, wherein the strip includes a distal tongue portion arranged to extend along an exterior surface of the container, a first inclined segment appended to an upper part of distal tongue portion and formed to include a lower hook receiver, and a second inclined segment appended to a lower part of the strip retainer and formed to include an upper hook receiver.

10. The mobile canister of claim 9, wherein the first inclined segment cooperates with the distal tongue portion to form an obtuse included angle therebetween, the second inclined segment cooperates with the strip retainer to form an obtuse included angle therebetween.

11. The mobile canister of claim 9, wherein the first inclined segment is curved and includes a convex surface facing toward the exterior surface of the container.

12. The mobile canister of claim 9, wherein the second inclined segment is substantially flat.

13. The mobile canister of claim 1, wherein the first inclined segment is curved and includes a convex surface facing toward the exterior surface of the container and the second inclined segment is substantially flat.

14. The mobile canister of claim 1, wherein the distal tongue portion has a width and the first inclined segment has a width that is greater than the width of the first inclined surface.

15. The mobile canister of claim 1, wherein the belt clip further includes a belt flange appended to the strip retainer to face and project toward an exterior surface of the container, the belt flange is arranged to lie in spaced-apart relation to the bracket to define a belt-receiving space located therebetween and also located between the strip and the exterior surface of the container and wherein the belt flange is formed to include an upper surface facing toward the bracket and providing means for engaging a lower edge of a belt worn by a person and arranged to extend through the belt-receiving space.

16. The mobile canister of claim 1, wherein the container includes an exterior surface facing toward the strip retainer to define a belt-receiving space therebetween and a rigidifying section appended to the exterior surface and arranged to project outwardly from the exterior surface in a direction away from the interior article-storage region, the bracket is coupled to the rigidifying section, and the strip retainer is arranged to contact the rigidifying section.

* * * * *